US010156360B2

(12) United States Patent
Lee

(10) Patent No.: US 10,156,360 B2
(45) Date of Patent: Dec. 18, 2018

(54) COMBUSTOR LINERS WITH ROTATABLE AIR GUIDING CAPS

(71) Applicant: DOOSAN HEAVY INDUSTRIES & CONSTRUCTION CO., LTD., Changwon-Si, Gyeongsangnam-Do (KR)

(72) Inventor: Dong Hun Lee, Yongin-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 462 days.

(21) Appl. No.: 14/996,534

(22) Filed: Jan. 15, 2016

(65) Prior Publication Data

US 2016/0348912 A1 Dec. 1, 2016

(30) Foreign Application Priority Data

May 27, 2015 (KR) ..... 10-2015-0074089

(51) Int. Cl.
*F01D 9/02* (2006.01)
*F01D 25/12* (2006.01)
(Continued)

(52) U.S. Cl.
CPC ..... *F23R 3/06* (2013.01); *F01D 9/023* (2013.01); *F01D 25/12* (2013.01); *F23M 5/08* (2013.01);
(Continued)

(58) Field of Classification Search
CPC ..... F02C 7/18; F01D 9/023; F01D 25/12; F05D 2250/241; F05D 2260/20;
(Continued)

(56) References Cited

U.S. PATENT DOCUMENTS 6,494,044 B1 12/2002 Bland
8,151,570 B2 4/2012 Jennings et al.
(Continued)

FOREIGN PATENT DOCUMENTS

KR 10-2008-0065553 A 7/2008
KR 10-13553730000 B1 1/2014

OTHER PUBLICATIONS

Communication dated Jul. 14, 2017, from Korean Intellectual Property Office in counterpart application No. 10-2015-0074089.
(Continued)

*Primary Examiner* — Logan Kraft
(74) *Attorney, Agent, or Firm* — Invenstone Patent, LLC

(57) ABSTRACT

A combustion liner includes air guiding caps which are respectively engaged to a mounting member and are turned in a flow direction of air so as to collect a fluid flowing around the combustion liner and feed it to the combustion liner, thereby smoothly introducing cooling air into the combustion liner. The combustion liner includes a plurality of through-holes which are formed in a surface of the combustion liner; and a plurality of air guiding caps provided on the combustion liner in plural rows arranged at regular intervals in a circumferential direction. With the above configuration, the combustion liner can instantaneously cope with irregular air flowing around the combustion liner to effectively introduce the air into the combustion liner, and can be varied in position and direction for the purpose of easy maintenance thereof.

13 Claims, 7 Drawing Sheets

(51) Int. Cl.

| | |
|---|---|
| ***F23M 5/08*** | (2006.01) |
| ***F23R 3/00*** | (2006.01) |
| ***F23R 3/06*** | (2006.01) |
| ***F23R 3/26*** | (2006.01) |

(52) U.S. Cl.
CPC ..... *F23R 3/002* (2013.01); *F23R 3/005* (2013.01); *F23R 3/26* (2013.01); *F23R 2900/03044* (2013.01)

(58) Field of Classification Search
CPC ..... F05D 2260/201; F05D 2260/205; F23M 5/08; F23R 3/002; F23R 3/005; F23R 3/045; F23R 3/06; F23R 3/26; F23R 2900/00005; F23R 2900/03044
See application file for complete search history.

(56) References Cited

U.S. PATENT DOCUMENTS

| | | | |
|---|---|---|---|
| 8,281,600 | B2 | 10/2012 | Chen et al. |
| 2003/0233832 | A1 | 12/2003 | Martling et al. |
| 2010/0251723 | A1 | 10/2010 | Chen et al. |
| 2013/0074501 | A1 | 3/2013 | Tiwary et al. |
| 2014/0318136 | A1 | 10/2014 | Saitou et al. |

OTHER PUBLICATIONS

International Search Report dated Mar. 29, 2016 in PCT/KR2015/014312.

COMBUSTOR LINERS WITH ROTATABLE AIR GUIDING CAPS

CROSS-REFERENCE TO RELATED APPLICATIONS

This application claims priority to Korean Application No. 10-2015-0074089, filed on May 27, 2015, the contents of which are incorporated herein in their entirety.

BACKGROUND

Field

The present disclosure relates to a combustor liner with rotatable air guiding caps that are provided on a surface of the combustor liner installed in a gas turbine, and are turned in a horizontal plane. In particular, the present disclosure relates to a combustion liner including air guiding caps which are respectively engaged to a mounting member and are turned in a flow direction of air so as to collect a fluid flowing around the combustion liner and feed it to the combustion liner, thereby smoothly introducing cooling air into the combustion liner.

Background of the Related Art

In general, a turbine generator used for a gas turbine power plant burns a fuel by a compressed air to generate strong energy and drive a turbine.

In the turbine generator, a combustor, in which an air/fuel mixture combusts, and a combustion liner for surrounding the combustor generate hot gases of high temperature.

A circulation cooling device is required to prevent the combustor and the combustion liner enclosing the combustor from overheating and being damaged, and thus prevent economic loss.

Conventionally, the surface of the combustion liner is subsidiarily machined according to a cooling method, so as to prevent the combustor and the combustion liner enclosing the combustor from overheating.

In the case of the above cooling method of subsidiarily machining the surface of the combustion liner, such machined portions cannot be altered. Therefore, there is a problem in that if air flowing around the combustion liner is varied, there is little measures to cope with variations in the air flow. Also, positions, direction and so forth of the machined portions are not altered in real time according to the variations in the air flow. Therefore, there is another problem in that if the machined portion is damaged or broken, a lot of labors and times are required to repair and maintain the damaged or broken machined portion.

Accordingly, although an additional device is designed to lower the temperature of the combustion liner, a separate device for machining the combustion liner is required to instantaneously cope with irregular air flowing around the combustion liner. Also, a position and a direction of the separate device should be varied to be easily maintained.

SUMMARY OF THE INVENTION

Therefore, the present disclosure has been made in view of the above problems, and an object of the present disclosure is to provide a combustion liner including air guiding caps which can instantaneously cope with irregular air flowing around the combustion liner, and can be varied in position and direction for the purpose of easy maintenance thereof.

In order to achieve the above object, there is provided a combustion liner for a turbine generator, including a plurality of air guiding caps provided on the combustion liner in plural rows arranged at regular intervals in a circumferential direction.

The air guiding caps are not necessarily arranged in row, but in order to collect and feed air effectively, an influence of back flow should be minimized. Therefore, it is preferable to arrange the air guiding caps in rows.

Alternatively, the air guiding caps may be arranged on the combustion liner at random.

The plurality of air guiding caps include a cover having one opened side, and a mounting member which is engaged to the cover so as to fix the cover, respectively.

In general, since the cover is engaged to the mounting member and is turned, the mounting member has a circular shape.

In addition, the respective covers of the air guiding caps are able to turn side by side in a state in which the covers are respectively engaged to the mounting members.

The respective covers of the air guiding caps have one plate member of a single structure, or at least two plate members which are overlapped or engaged to each other.

If the air guide cap includes at least two plate members, the plate members are partially overlapped with each other, and the plate members are hinged by a pin and a hole which are formed on sides of the plate members, so that the plate members are moved in a vertical direction to secure an air introducing angle.

Preferably, the respective air guiding caps has a direction adjusting member therein, and the direction adjusting members are configured to be fixed to the air guiding caps, and turned together with the air guiding caps.

Each of the direction adjusting members has two sector-shaped members which are engaged to each other at a desired angle, and in a case where the air flows in the opened side of the cover, when the flow direction of the air is changed to the left or right side, the direction of the cover is changed by the direction adjusting member which is fixed to the cover.

Therefore, since the direction adjusting member is fixed to the inside of the air guiding cap, each air guiding cap can be positioned to look straight on the air flowing into the cover, irrespective of frequently variations in flow of the air.

In addition, the plurality of air guiding caps are configured to be detachably mounted to the combustion liner.

The detachable structure may employ screw engagement, and the air guiding caps can be detachably mounted to the combustion liner in the state in which the cover is engaged to the mounting member.

It is preferable that a surface of the combustion liner is provided with joint grooves, so as to detachably mount the air guiding caps to the surface of the combustion liner.

The air guiding caps can be detachably mounted to the surface of the combustion liner, and the combustion liner may be provided with a plurality of joint grooves of a desired depth so as to easily mount the air guiding caps to the combustion liner.

Alternatively, the air guiding caps may be detachably mounted to an inside of the combustion liner, and the combustion liner may be machined to have a plurality of joint grooves of a desired depth so as to easily mount the air guiding caps to the inside of the combustion liner.

In addition, each of the air guiding caps has a protrusion protruding from one side of the mounting member.

A shape of the protrusion is not limited to a rectangular shape, but is generally formed on one side of the mounting member.

Preferably, the combustion liner is provided with recessed portions corresponding to the protrusions of the air guiding caps.

The protrusion of the air guiding cap and the recessed portion of the combustion liner are configured to prevent the air guiding cap from being turned due to the influence of the air flow in the state in which the air guiding cap is attached to the combustion liner, and to give the mounting members with uniform orientation.

As described above, the combustion liner for the turbine generator includes the plurality of air guiding caps provided on the combustion liner in plural rows arranged at regular intervals in the circumferential direction. Therefore, the combustion liner can instantaneously cope with the irregular air flowing around the combustion liner to effectively introduce the air into the combustion liner, and can be easily repaired and maintained.

DETAILED DESCRIPTION OF THE PREFERRED EMBODIMENT

Reference will be now made in detail to embodiments of the present disclosure with reference to the attached drawings. It will be understood that words or terms used in the specification and claims shall not be interpreted as the meaning defined in commonly used dictionaries. It will be further understood that the words or terms should be interpreted as having a meaning that is consistent with their meaning in the context of the relevant art and the technical idea of the disclosure.

Figure 1:
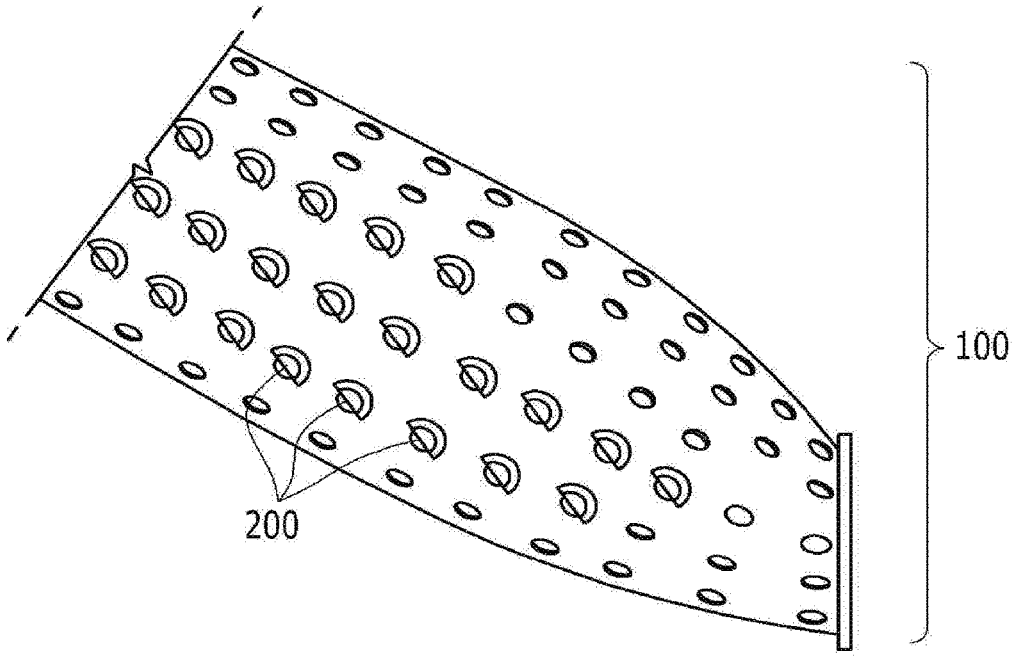
FIG. 1 is a side view of a combustion liner with air guiding caps arranged in row, according to a first embodiment.

FIG. 1 is a side view of a combustion liner with a plurality of air guiding caps arranged in row, according to a first embodiment.

In this instance, air guiding caps 200 are not necessarily arranged in a row(s), but in order to collect and feed air effectively, an influence of back flow should be minimized. Therefore, it is preferable to arrange the air guiding caps in row(s).

Alternatively, the air guiding caps 200 may be arranged on a combustion liner 100 at random.

The air guiding cap 200 is not fixed to the combustion liner 100, but serves as a dependent component by an engaging groove 110 and a mounting member 220 (FIG. 6) which will be described later.

The air guiding cap 200 is configured to collect air and feed it to the inside of the combustion liner 100, so that the air guiding cap serves as a means for cooling the air flowing between the combustion liner and a flow sleeve.

Figure 2:
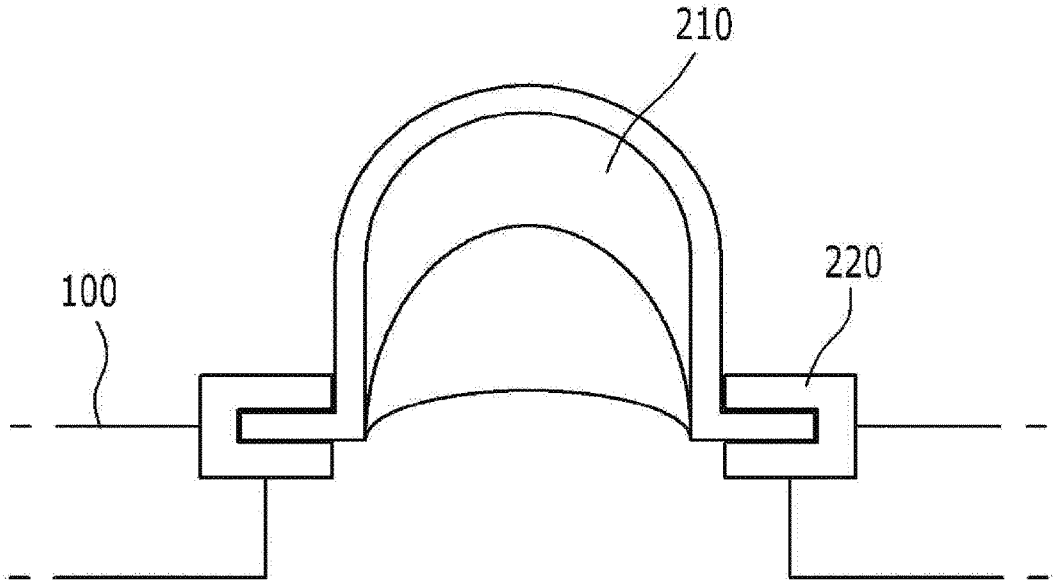
FIG. 2 is a cross-sectional view illustrating an engaging state of a cover of the air guiding cap and a mounting member, according to the first embodiment.

FIG. 2 is a cross-sectional view illustrating the engaging state of a cover 210 of the air guiding cap 200 and the mounting member 220, according to the first embodiment.

The cover 210 is not limited to a concrete shape, but a dome shape is generally effective in view of collection of a fluid and feed of the collected fluid.

At least one plate member 211 configuring the cover 210 has a bent end which is positioned at the lowermost position, and the bent end is able to engage to the mounting member 220.

The engagement means that the plate member 211 is not firmly engaged to the mounting member 220, but is freely moved in the state of being engaged to the mounting member.

In the case of the cover 210 which has two or more plate members 211, it is preferable that a corner of a lower end of the upper plate member 211 is formed with a pin at an outside thereof, and a corner of a lower end of the lower plate member 211 is formed with a hole at a position corresponding to the pin, so that the pin is inserted into the hole and is rotated therein.

With the above configuration, the cover 210 of the air guiding cap 200 can be freely moved side by side, and at least two plate members 211 configuring the cover are freely moved within a desired range, so that an optimum covering angle of the cover 210 can be set according to an upward flow angle of the air.

Figure 3:
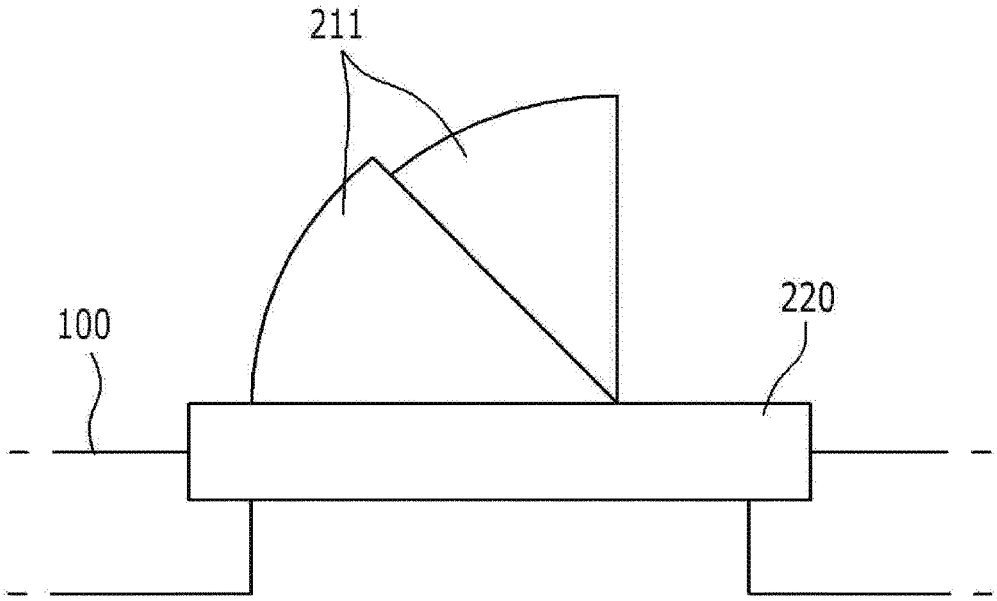
FIG. 3 is a side view illustrating an engaging state of a cover of the air guiding cap and a mounting member, according to the first embodiment.

FIG. 3 is a side view illustrating the engaging state of the cover of the air guiding cap and the mounting member, according to the first embodiment.

Figure 4:
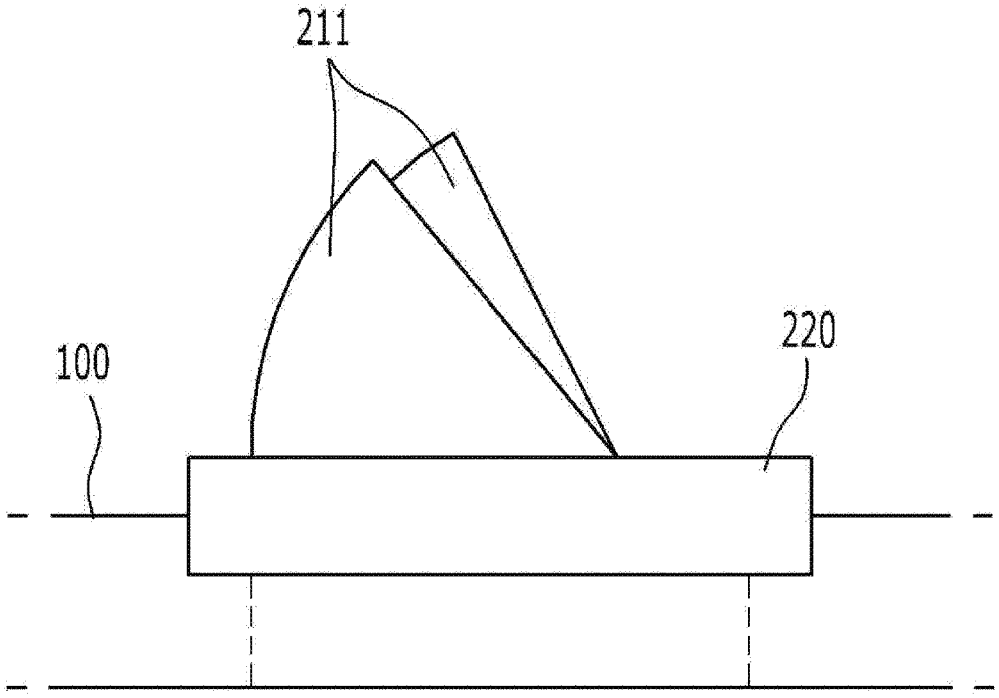
FIG. 4 is a side view illustrating the mounting member and the cover of the air guiding cap with at least two plate members which are overlapped with each other, according to the first embodiment.

As can be seen from the side views in FIGS. 3 and 4, in the case of the cover 210 which has at least two plate members 211, the upper or inner plate member 211 is overlapped with a portion of the lower or outer plate member 211, so that the optimum covering angle of the cover 210 can be set according to the upward flow angle of the air.

FIG. 4 is a side view illustrating the mounting member and the cover of the air guiding cap with at least two plate members which are overlapped with each other, according to the first embodiment.

As described above, in the case of the cover 210 which has at least two plate members 211, the upper or inner plate member 211 is overlapped with a portion of the lower or outer plate member 211, so that the optimum covering angle of the cover 210 can be set according to the upward flow angle of the air.

Figure 5:
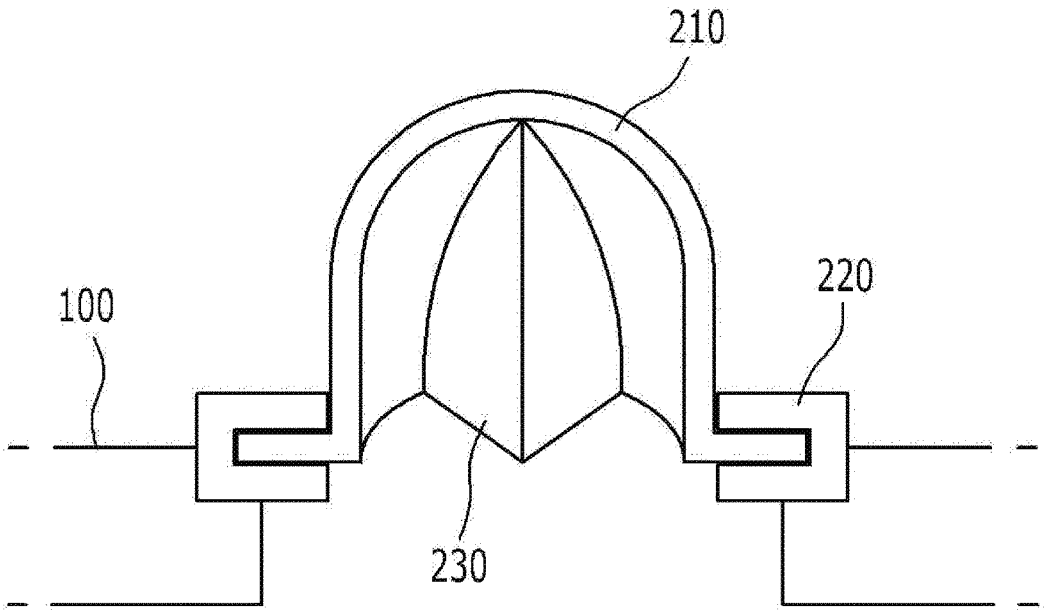
FIG. 5 is a cross-sectional view illustrating a direction adjusting member which is fixed to an inside of the air guiding cap, according to the first embodiment.

FIG. 5 is a cross-sectional view illustrating a direction adjusting member which is fixed to the inside of the air guiding cap, according to the first embodiment.

A direction adjusting member 230 may have two sector-shaped members which are engaged to each other at a desired angle. In a case where the air flows in the opened side of the cover 210, when the flow direction of the air is changed to the left or right side, the direction of the cover 210 is also changed by the direction adjusting member 230 which is fixed to the cover, due to air resistance.

Also, since the direction adjusting member 230 is fixed to the inside of the air guiding cap 200, when an incoming angle of the air flowing into the cover 210 is changed in a horizontal direction along a horizontal axis, each air guiding cap 200 can be positioned to look straight on the air flowing into the cover, irrespective of the frequent variations in flow of the air.

In addition, the direction adjusting member 230 may have a porous surface so as to allow the air to more smoothly come in.

Figure 6:
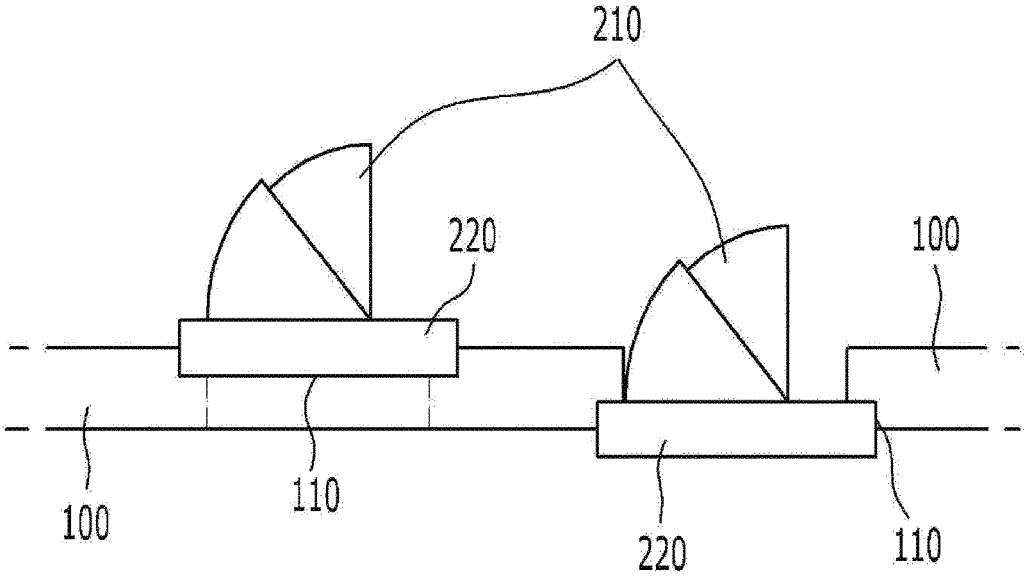
FIG. 6 is a side view illustrating the air guiding cap which is provided to a surface or inside of the combustion liner according to the first embodiment.

FIG. 6 is a side view illustrating the air guiding cap which is provided to the surface or inside of the combustion liner according to the first embodiment.

The air guiding cap 200 is configured so that the air guiding cap and the mounting member 220 are detachably mounted to the combustion liner 100. The detachable structure may employ screw engagement, and the air guiding cap 200 can be detachably mounted to the combustion liner 100 in the state in which the cover 210 is engaged to the mounting member 220.

The air guiding caps 200 can be provided on the surface or inside of the combustion liner 100. It is preferable that the surface or inside of the combustion liner 100 is provided with a joint groove 110 which is machined at a desired depth, so as to easily mount the air guiding cap to the combustion liner 100.

The combustion liner 100 may be provided with a plurality of joint grooves 110 in advance. In the case of installing the air guiding caps 200 or reinstalling the air guiding caps after repairing, the air guiding caps 200 can be installed to any of previously formed joint grooves 110 at desired positions which are determined to improve the cooling efficiency of the combustion liner 100.

Figure 7:
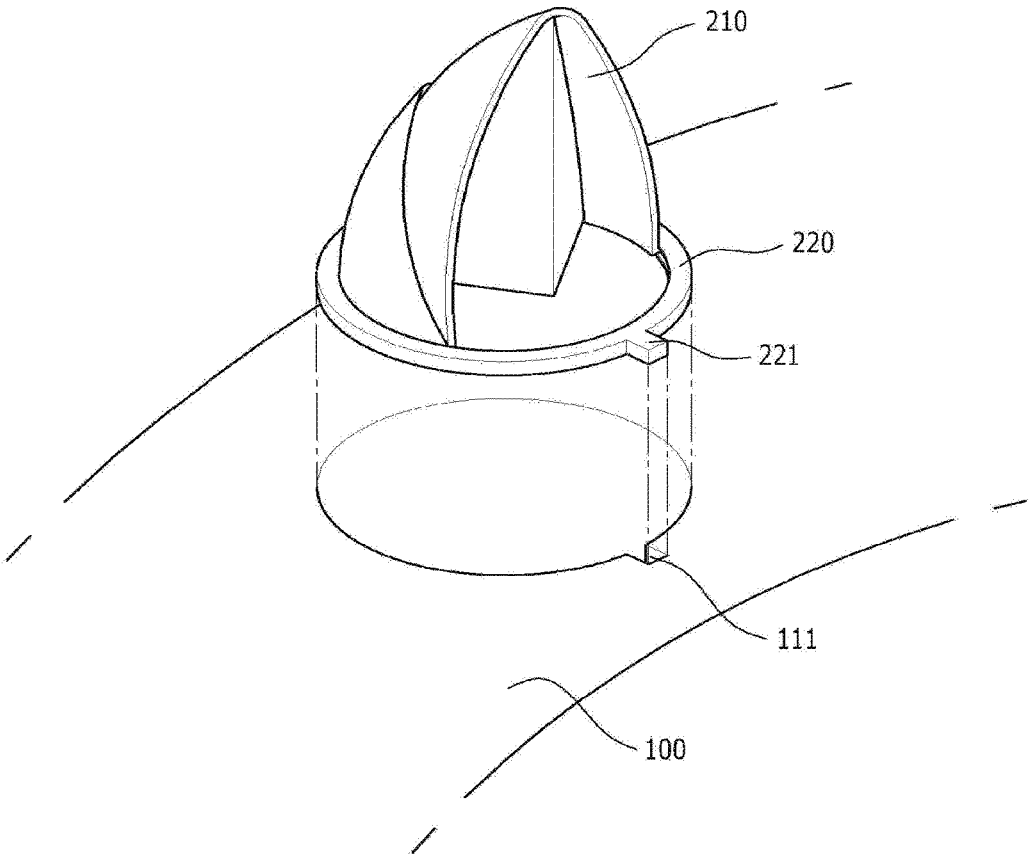
FIG. 7 is a view schematically illustrating a protrusion of the mounting member for the air guiding cap, and a recessed portion of the combustion liner corresponding to the protrusion, according to the first embodiment.

FIG. 7 is a view schematically illustrating a protrusion of the mounting member for the air guiding cap, and a recessed portion of the combustion liner corresponding to the protrusion, according to the first embodiment.

A shape of a protrusion 221 is not limited to a rectangular shape, but is generally formed on one side of the mounting member 220.

The protrusion 221 of the air guiding cap 200 and a recessed portion 111 of the combustion liner 100 are configured to prevent the air guiding cap 200 from being turned due to the influence of the air flow in the state in which the air guiding cap 200 is attached to the combustion liner 100, and to give the mounting members 220 uniform orientation.

Figure 8:
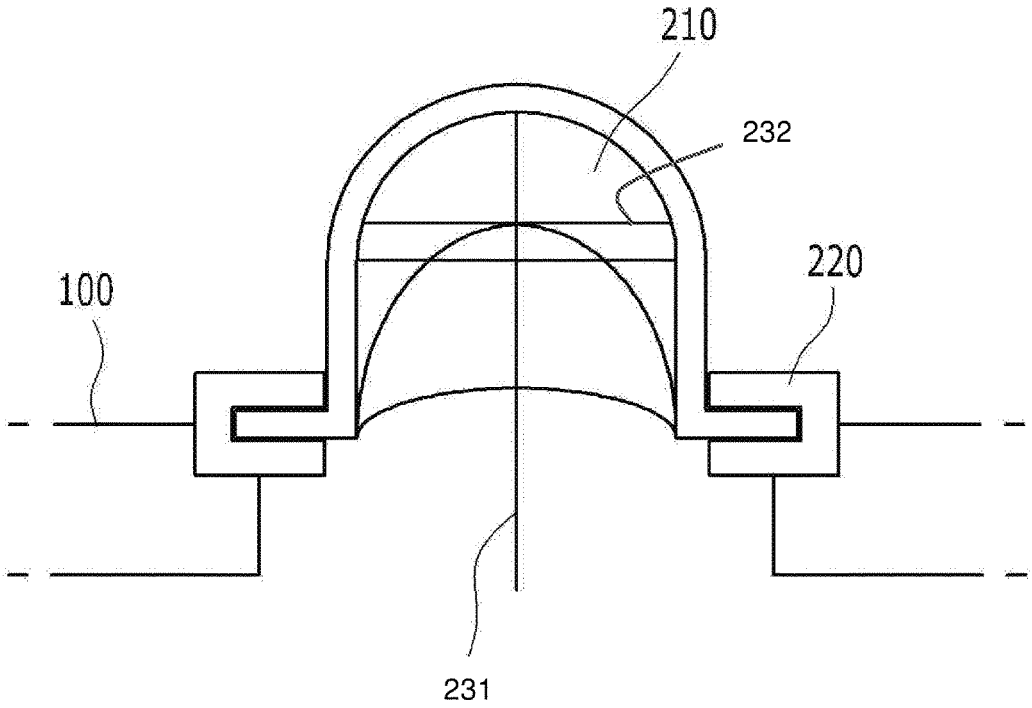
FIG. 8 is a front view of the air guiding cap according to the first embodiment.
Figure 9:
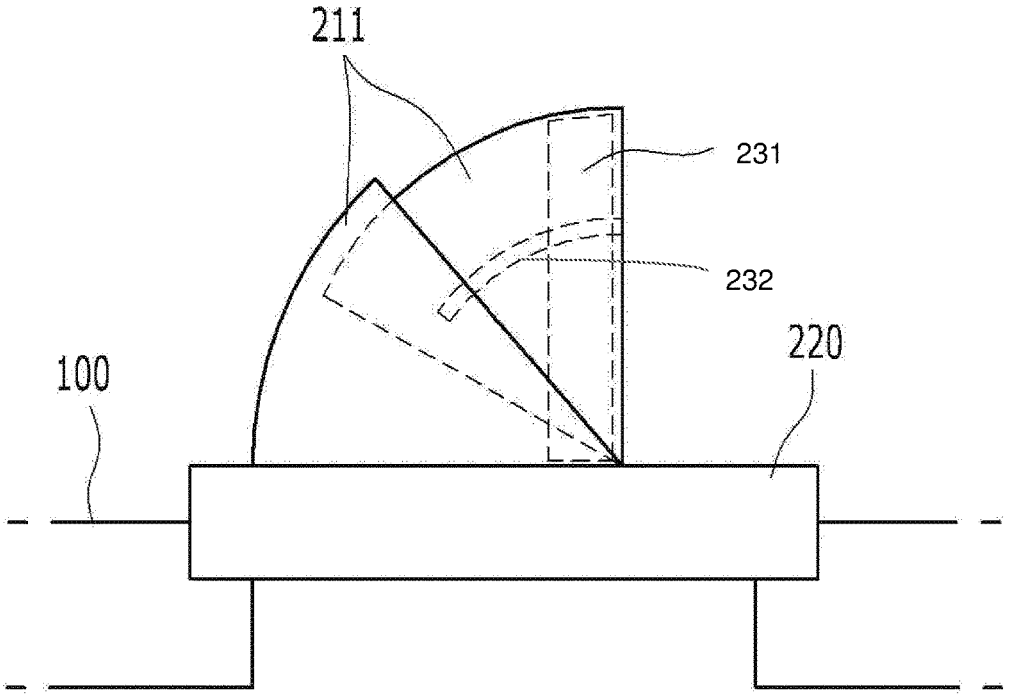
FIG. 9 is a side view of the air guiding cap according to the first embodiment.

Referring to FIGS. 8 and 9, the combustion liner may include a vertical direction adjusting member 231 and a horizontal direction adjusting member 232. The horizontal direction adjusting member 232 and the vertical direction adjusting member 231 receive the air flowing at a desired angle, and allow the plate member 211 to automatically rotate on the basis of the horizontal direction adjusting member 232.

The vertical direction adjusting member 231 and the horizontal direction adjusting member 232 do not have a cubic shape, but have a planar structure. The plate members 211 can effectively collect the air flow, without being interrupted by the vertical and horizontal direction adjusting members.

Further, the embodiments discussed have been presented by way of example only and not limitation. Thus, the breadth and scope of the disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the disclosure set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A combustion liner for a turbine generator, comprising:
   - a plurality of through-holes formed in a surface of the combustion liner; and
   - a plurality of air guiding caps provided on the combustion liner in plural rows arranged at regular intervals in a circumferential direction of the combustion liner, and configured to introduce air into the combustion liner, wherein the plurality of air guiding caps include:
     - a cover having one opened side configured to receive an air flow and a bent end positioned at a lowermost position of the cover, and
     - a mounting member configured to be movably engaged to the bent end of the cover so that the cover is movable with respect to the mounting member while being engaged with the mounting member, and wherein the mounting member is configured to removably mount the air guiding cap to the combustion liner.

2. The combustion liner according to claim 1, wherein the covers of the air guiding caps are configured to rotate with respect to the covers while in a state in which the covers are respectively engaged to the mounting members.

3. The combustion liner according to claim 2, wherein the respective covers of the air guiding caps have one plate member of a single structure, or at least two plate members which are overlapped or engaged to each other.

4. The combustion liner according to claim 2, wherein each of the respective air guiding caps has a direction adjusting member fixed to an inner surface of the covers, and rotates together with the covers with respect to the mounting member while in a state of being mounted to the mounting member.

5. The combustion liner according to claim 2, wherein the plurality of air guiding caps are configured to be detachably engaged to the combustion liner, respectively.

6. The combustion liner according to claim 5, wherein the surface of the combustion liner is provided with a plurality of joint grooves configured to mount the air guiding caps to the surface of the combustion liner.

7. The combustion liner according to claim 1, wherein the respective covers of the air guiding caps include one plate member (211) of a single structure, or at least two plate members (211) which are overlapped or engaged to each other.

8. The combustion liner according to claim 1, wherein each of the respective air guiding caps has a direction adjusting member fixed to an inner surface of the covers, and rotated together with the covers with respect to the mounting member while in a state of being mounted to the mounting member.

9. The combustion liner according to claim 1, wherein the plurality of air guiding caps are configured to be detachably engaged to the combustion liner, respectively.

10. The combustion liner according to claim 9, wherein the surface of the combustion liner is provided with a plurality of joint grooves configured to mount the air guiding caps to the surface of the combustion liner.

11. The combustion liner according to claim 9, wherein an inside surface of the combustion liner is provided with a plurality of joint grooves corresponding to the through holes, and configured to mount the air guiding caps to the inside surface of the combustion liner.

12. The combustion liner according to claim 9, wherein each of the respective air guiding caps has a protrusion protruding from one side of the mounting member.

13. The combustion liner according to claim 12, wherein the combustion liner includes recessed portions formed at the through holes, corresponding in shape to the protrusions of the air guiding caps and configured to receive the protrusions.

* * * * *